US007810348B2

(12) United States Patent
Shewchuk

(10) Patent No.: US 7,810,348 B2
(45) Date of Patent: Oct. 12, 2010

(54) BEVERAGE CONTAINER WITH FREEZE PACK

(75) Inventor: Jeffrey D. Shewchuk, Inver Grove Heights, MN (US)

(73) Assignee: Grand-Bonanza Enterprise, Inc., Taipei (TW)

( * ) Notice: Subject to any disclaimer, the term of this patent is extended or adjusted under 35 U.S.C. 154(b) by 214 days.

(21) Appl. No.: 11/773,131

(22) Filed: Jul. 3, 2007

(65) Prior Publication Data

US 2008/0000259 A1 Jan. 3, 2008

Related U.S. Application Data

(60) Provisional application No. 60/818,090, filed on Jul. 3, 2006.

(51) Int. Cl.
*F25D 3/08* (2006.01)

(52) U.S. Cl. ..... 62/457.3; 62/457.1; 62/530

(58) Field of Classification Search ..... 62/457.3, 62/530, 457.1, 457.2
See application file for complete search history.

(56) References Cited

U.S. PATENT DOCUMENTS 3,840,153 A 10/1974 Devlin
5,009,083 A 4/1991 Spinos et al.
5,129,238 A 7/1992 Schwartz et al.
5,456,090 A 10/1995 McCoy
5,507,156 A 4/1996 Redmon
6,123,065 A * 9/2000 Teglbjarg ..... 126/263.09
6,494,056 B1 * 12/2002 Roth et al. ..... 62/457.3
6,584,800 B1 7/2003 Roth et al.
6,761,041 B2 7/2004 Roth et al.
6,938,436 B2 9/2005 Roth et al.
7,051,550 B2 5/2006 Roth et al.
7,069,739 B2 * 7/2006 Porter ..... 62/457.3

* cited by examiner

*Primary Examiner*—Melvin Jones
(74) *Attorney, Agent, or Firm*—Shewchuk IP Services, LLC; Jeffrey D. Shewchuk

(57) ABSTRACT

A container has a thermal pack aligned on a central axis of the container. The thermal pack includes a material such as a phase change material for cooling (or heating) the liquid in the container. The thermal pack attaches to the container such as by a threaded connection in a receiving tube, which makes full circumferential contact with an end of the thermal pack. The container has a drinking or pouring opening aligned relative to the thermal pack, but completely separated from the thermal pack. Radial flow slots permit fluid to flow from the container interior through the drinking or pouring opening.

18 Claims, 5 Drawing Sheets

BEVERAGE CONTAINER WITH FREEZE PACK

CROSS-REFERENCE TO RELATED APPLICATION(S)

This application claims priority from provisional application No. 60/818,090, filed Jul. 3, 2006.

BACKGROUND OF THE INVENTION

The present invention relates to containers for storing, serving or drinking cooled liquids, and particularly to sport bottle containers.

Containers have long been used storing, serving or drinking liquids. Liquids can be cooled by freezing the liquid or adding ice, but some containers have included cold packs, freeze packs or phase change material packs to keep liquid in the container cooled. Examples include U.S. Pat. Nos. 3,840,153, 5,009,083, 5,129,238, 5,456,090, 5,507,156, 6,494,056, 6,584,800, 6,761,041, 6,938,436 and 7,051,550, all incorporated by reference. However, none of these various designs provide an optimal solution for keeping the liquid in the container cold.

Some of these containers include the phase change material in the peripheral walls of the container. While this is a solution that rapidly cools the liquid added inside the container, it also tends to take up more space in the freezer, and leaves an exposed outer surface of the container which is quite cold for handling the container and may "sweat" or have significant condensation problems on the outside of the container during use.

Some of these containers include a straw or drinking opening which is unbalanced relative to the freeze pack, having either or both the drinking opening and the freeze pack offset relative to a central axis of the container. See for instance U.S. Pat. Nos. 3,840,153 and 5,129,238. The big advantage to such an offset arrangement is that the attachment mechanism for the freeze pack can be designed entirely separate and without concern for the drinking opening. It is generally preferred however, to provide a uniform balanced feel to the container, both during drinking (which requires the drinking opening to be centered in the container) and during handling such as when the container is only partially full (which requires the freeze pack to be centered in the container).

The containers disclosed in U.S. Pat. Nos. 5,009,083 and 5,507,156 center both the freeze pack and the straw/drinking opening in the center of the container by having the straw centered in an annular freeze pack, but the annular shape of the freeze pack is overly complicated and expensive to manufacture. The containers disclosed in U.S. Pat. Nos. 5,456,090, 6,494,056 and 6,584,800 center both the freeze pack and the drinking opening but have a relatively flimsy (and unnecessarily complicated) attachment arrangement for the freeze pack. The container can be treated roughly (such as when thrown from one consumer to another), and the freeze pack should have a simple, robust attachment mechanism to keep it in the center of the beverage container. Better designs for containers having freeze packs therein are needed.

BRIEF SUMMARY OF THE INVENTION

The present invention is container having a thermal element therein. The thermal element is preferably aligned on a central axis of the container. The thermal element includes a material such as a phase change material for cooling the liquid in the container. The thermal element attaches to the container such as by a threaded connection, making full peripheral contact between the thermal element and the container to support the thermal element. The container then has a drinking or pouring opening aligned relative to the thermal element, but completely separated from the thermal element.

Figure 1:
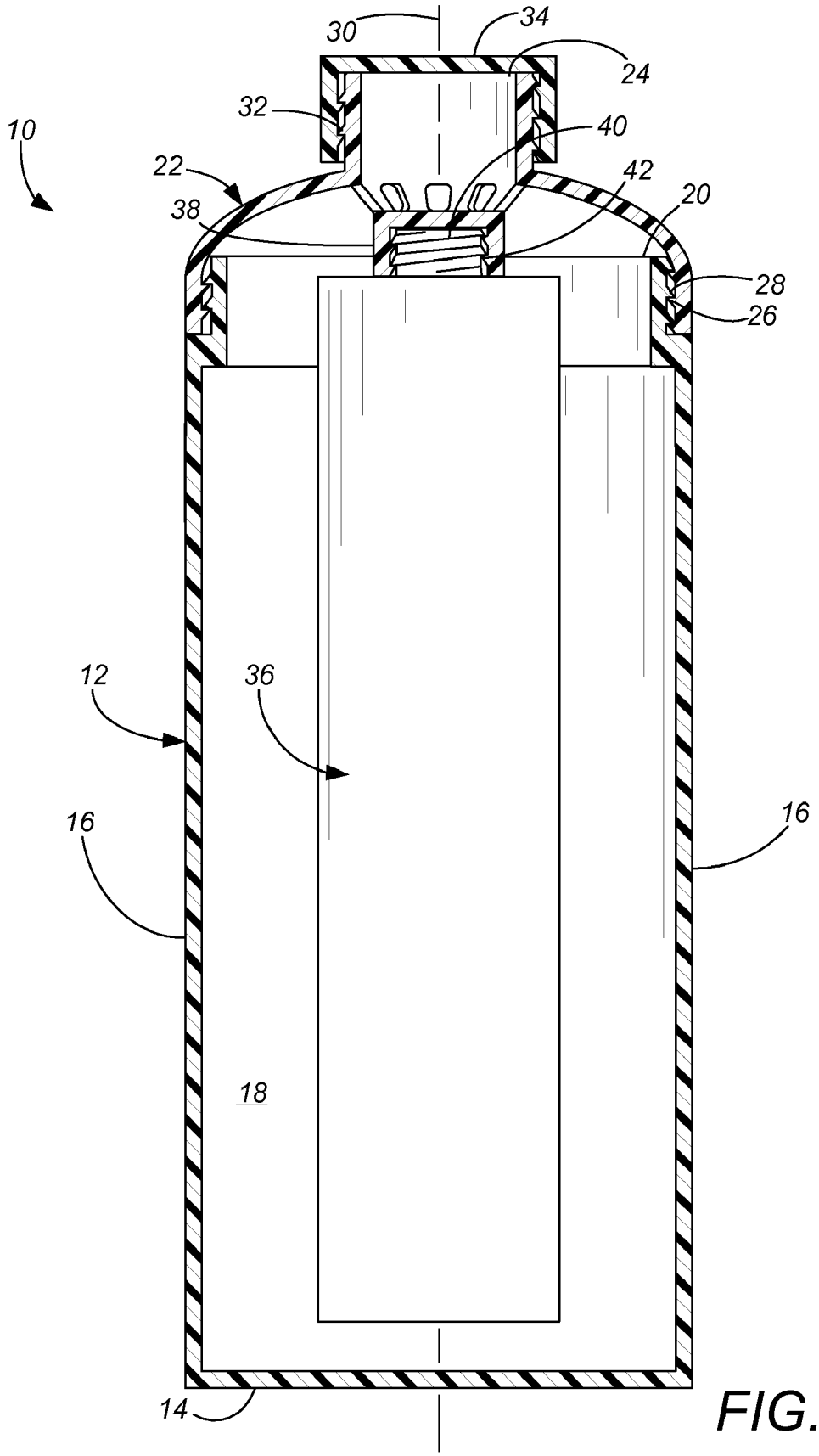
FIG. 1 is a cross-sectional view showing a container, lid and freeze pack (freeze pack shown in side view, not in cross-section) in accordance with the present invention.

While the above-identified drawing figures set forth preferred embodiments, other embodiments of the present invention are also contemplated, some of which are noted in the discussion. In all cases, this disclosure presents the illustrated embodiments of the present invention by way of representation and not limitation. Numerous other minor modifications and embodiments can be devised by those skilled in the art which fall within the scope and spirit of the principles of this invention.

DETAILED DESCRIPTION

The present invention includes a container 10 for holding a liquid, and particularly for heating or cooling the liquid placed inside the container 10. The container 10 has a bottom body portion 12, which includes a base 14 and upwardly extending side walls 16. The base 14 allows the container 10 to be placed on a flat surface, such as a table or counter. The side walls 16 extend around a periphery to define a container interior 18 for receiving liquid. The top of the side walls 16 define a relatively wide mouth 20 of the body 12. The mouth 20 of the body 12 is preferably (but not necessarily) used for filling the container 10. The container body 12 can be formed in any desired shape, with a preferred shape being cylindrical with a relatively constant wall thickness for simplicity and low cost in manufacture. If desired, the body could alternatively be rectangular or molded, including molded in any ornamental container shape.

A lid 22 attaches at the top of the body portion 12, covering the body mouth 20. The lid 22 includes a drinking opening 24. The lid 22 is preferably readily detachable and reattachable to the body 12, so the lid 22 can be quickly removed for refilling the container 10 and then replaced. In the preferred embodiment, the lid 22 includes threads 26 which mate with corresponding threads 28 on the container body 12. In this way, the lid 22 can be readily screwed onto or off of the container body 12. The threaded attachment defines a central axis 30 for the container 10. Alternatively, due to the design of the lid 22, refilling the container 10 could be accomplished solely through the drinking opening 24, and the lid 22 could be permanently attached to the body 12. In any event, the lid 22 is preferably molded from plastic such as by injection molding, separately from the body 12. Being formed separately from the lid 22, the body 12 can be formed through a different low cost method such as by blow molding. Depending upon the desired use of the container 10, the body 12 could be formed of other non-plastic materials or in other methods as known or invented in the container art.

The drinking opening 24 preferably includes structure facilitating drinking, and also preferably includes structure facilitating sealing. In the preferred embodiment, the drinking opening is a relatively wide drinking mouth 24 extending upwardly from the lid 22, with threads 32 on the periphery of the drinking mouth 24 for receiving a cap 34. In the preferred embodiment, the drinking mouth 24 and its threads 32 are aligned with the central axis 30. Alternatively the drinking opening could be a straw, straw opening, spout, pouring opening or similar structure as known or invented in the container art. The sealing structure could be a sport spout or a flip cap, or any other sealing structure as known or invented in the container art. If desired, the drinking opening could be offset from the central axis 30 of the container 10.

A thermal pack 36 is received in the container 10 for thermal exchange with the liquid in the container 10. The preferred thermal pack 36 is a phase change material or freeze pack formed as a plastic enclosure with a high latent heat of fusion material sealed therein. When the container 10 is intended for beverages, the phase change material should be non-toxic, so any leakage of phase change material will not have harmful effects. A preferred phase change material is water, which can be placed into a home freezer and frozen, and then melts inside the thermal pack 36 to keep the liquid in the container 10 cold. For ease of description, the thermal pack will be referred to as a freeze pack 10. However, the invention is equally applicable if the thermal pack 10 has a different construction, such as to keep the liquid in the container 10 warm.

The freeze pack 36 is supported by the lid 22, preferably aligned with the central axis 30. By aligning the freeze pack 36 with the central axis 30, the container 10 feels balanced to the user, and is less likely to tip when partially or largely empty. Aligning the freeze pack 36 with the central axis 30 also makes the container 10 fly truer if one consumer tosses the container 10 to another user, because the center of gravity of the freeze pack 36 matches the central axis 30 of the container 10. Further, aligning the freeze pack 36 with the central axis 30 also makes the lid 22 easier to screw onto or off of the body 12, because the freeze pack 36 will keep the same general location in the body 12 when the lid 22 is screwed relative to the body 12. For instance, if the liquid in the container 10 freezes around the freeze pack 36, the lid 22 and the freeze pack 36 (once released from the ice) may still be removable because the freeze pack 36 travels in a line upward when the lid 22 is unscrewed. The preferred freeze pack 36 is shaped as a cylinder, making manufacture of the freeze pack 36 easy and low cost. If desired, the freeze pack can be provided with an alternative shape, such as rectangular or with an ornamental molded shape.

Figure 3:
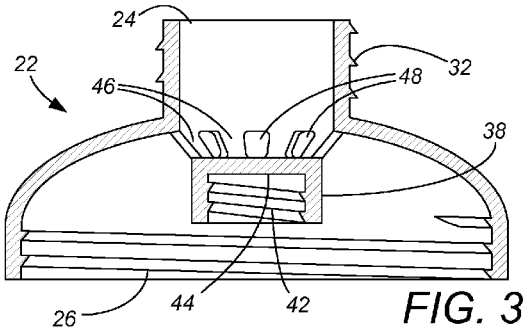
FIG. 3 is a cross-sectional view of the lid taken along lines 3-3 from FIG. 2.
Figure 2:
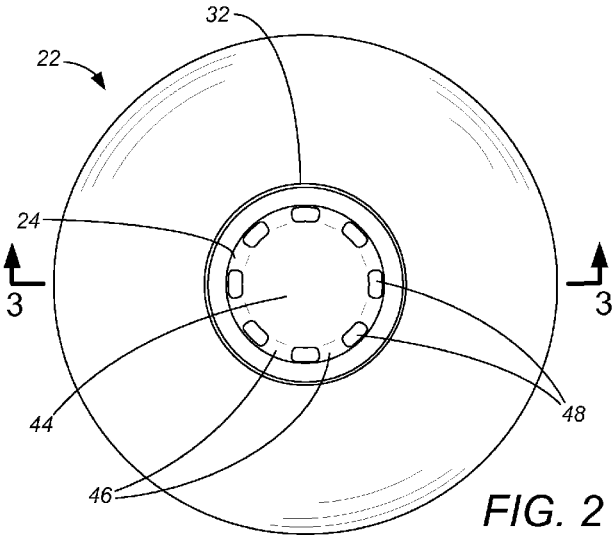
FIG. 2 is a top view of the lid of FIG. 1.
Figure 6:
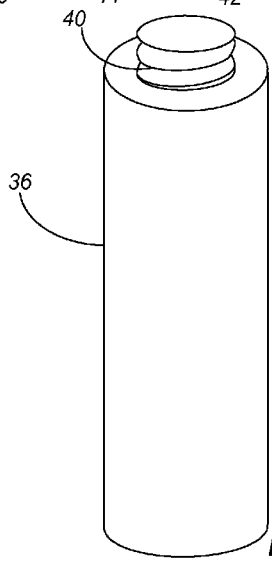
FIG. 6 is a perspective view from above of the freeze pack of FIG. 1.
Figure 4:
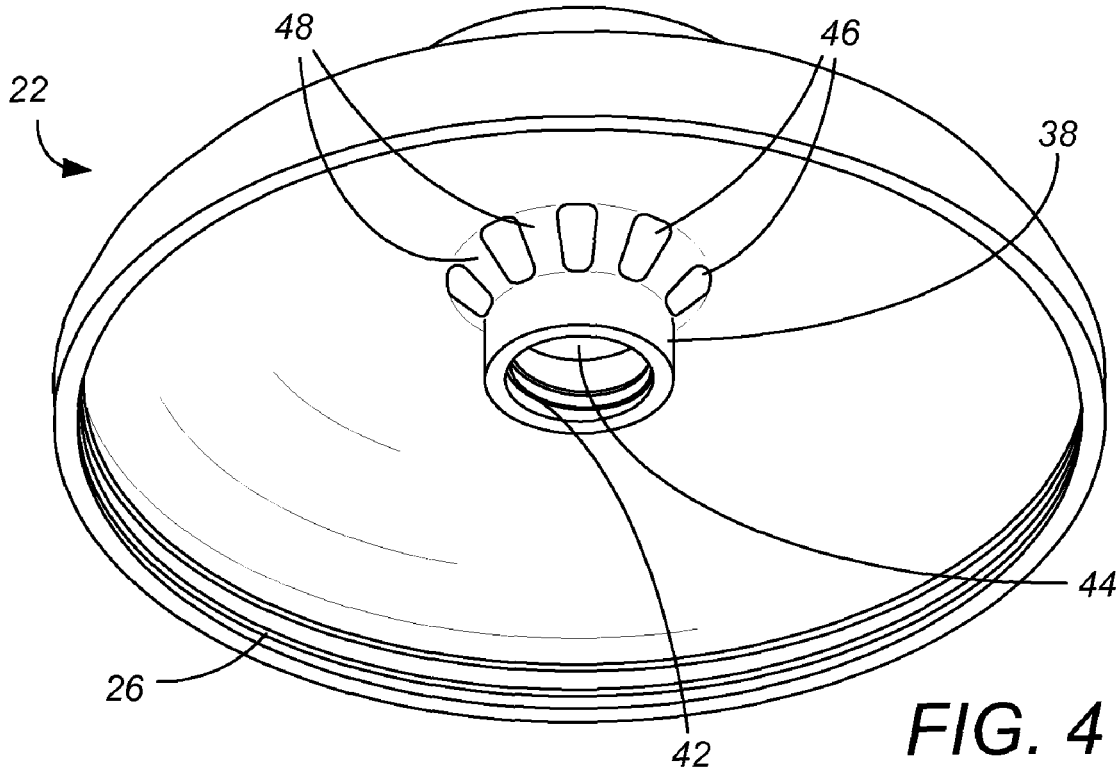
FIG. 4 is perspective view from below of the lid of FIGS. 1-3.
Figure 5:
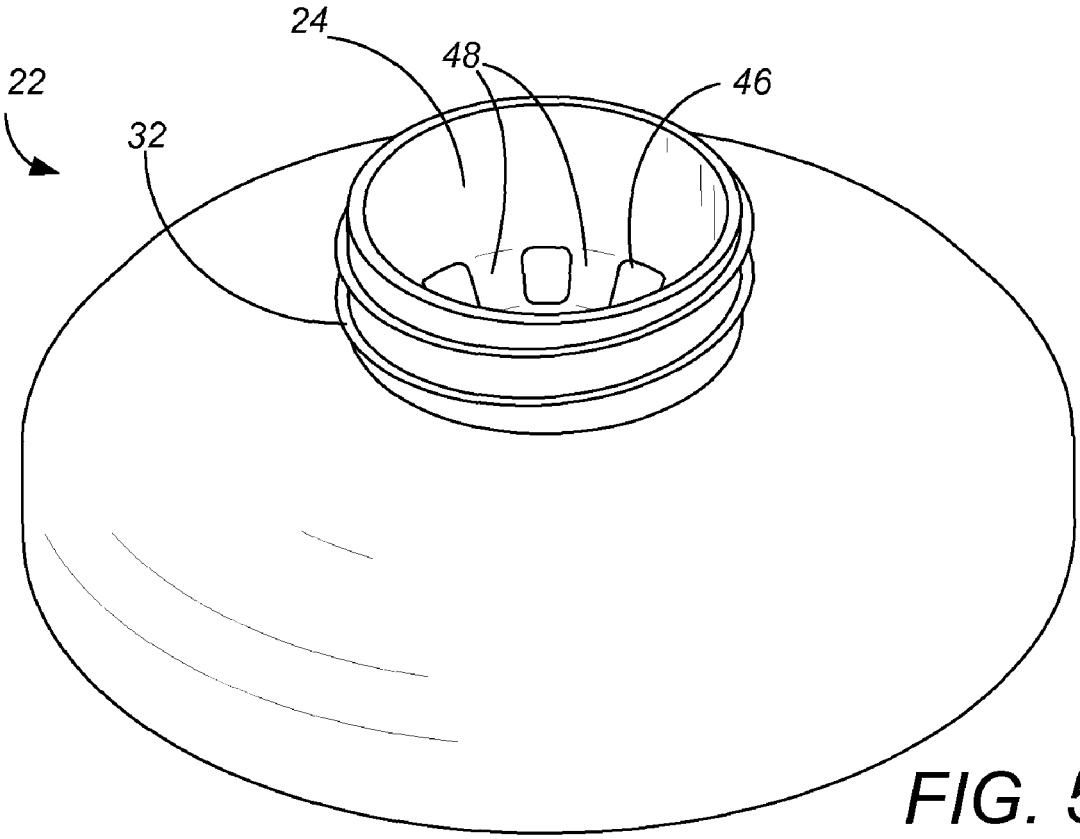
FIG. 5 is a perspective view from above of the lid of FIGS. 1-4.

Though detachable for separate freezing, the freeze pack 36 can be firmly attached relative to the container 10. The preferred method of firm attachment is through a threaded connection having in excess of 360° rotation to securely thread the freeze pack 36 to a receiving tube 38 on the container 10. In the preferred embodiment, the freeze pack 36 has male threads 40 on one of its ends which mate with female threads 42 on the lid 22. The receiving tube 38 makes full and continuous peripheral contact with the threaded end 40 of the freeze pack 36 to equally hold the freeze pack 36 in place in all directions. The receiving tube 38 includes a horizontally disposed back stop wall 44 (called out in FIGS. 2-4) for full seating of the freeze pack 36 when screwed into the receiver tube 38. Because the receiving tube 38 surrounds and supports the end 40 of the freeze pack 36 from all directions, the freeze pack 36 is less likely to detach when jolted, such as when the container 10 is dropped or thrown and caught from one consumer to another. Other alternative constructions which would permit the full peripheral contact between the freeze pack 36 and the lid 22 would be a male threaded projection on the lid 22 received into a threaded recess in the freeze pack 36, or a vertical sliding connection between an end of the freeze pack 36 and the receiving tube 38. With the preferred threaded connection, the freeze pack 36 and the lid 22 can be formed at low cost and still provide a tight detachable connection.

Extensions 46 (called out in FIGS. 2-5) are provided to attach the receiving tube 38 as part of the lid 22. Extensions 46 can extend axially, radially or both axially and radially (i.e., sloped) to attach the receiver tube 38 to the rest of the lid 22. Radial slots 48 are provided between the extensions 46 to provide fluid communication for fluid to flow radially from the interior 18 of the container 10 through the drinking opening 24 in the lid 22. Having sloped extensions 46 assists in making the lid 22 formable as a single unitary piece through injection molding while minimizing side actions on the mold. In the preferred embodiment, a plurality of flow slots 48 are circumferentially spaced in a conical wall of the lid 22 defined by the plurality of extensions 46, with the conical wall extending from the horizontal wall 44 upwardly and outwardly relative to the central axis 30.

The receiver tube 38 can have a larger, smaller or the same diameter as the drinking or pouring opening 24. In the preferred embodiment, the receiver tube 38 has an outer diameter which is slightly smaller than the inner diameter of the drinking opening 24. This permits a vertical line of sight into the interior 18 of the container 10, so the consumer can readily understand the function of the container 10 and lid 22 and so the consumer can readily consider filling the container 10 through the slots 48 of the lid 22.

Figure 7:
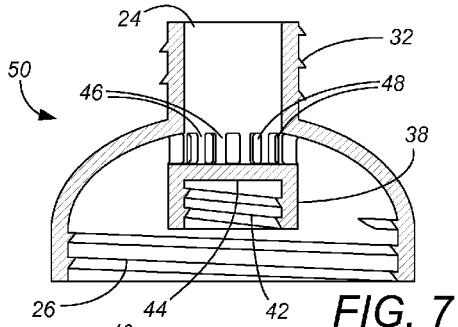
FIG. 7 is a cross-sectional view of an alternative lid in accordance with the present invention.

FIG. 7 depicts an alternative embodiment of a lid 50 in which the extensions 46 extend vertically, with the receiver tube 38 having the same inner and outer diameter as the drinking opening 24. By having the extensions 46 extend vertically, the lid 50 can be formed of a smaller diameter for a smaller container. The receiver tube 38 still makes full peripheral contact with the freeze pack 36 to hold the freeze pack 36 tightly in place.

Figure 8:
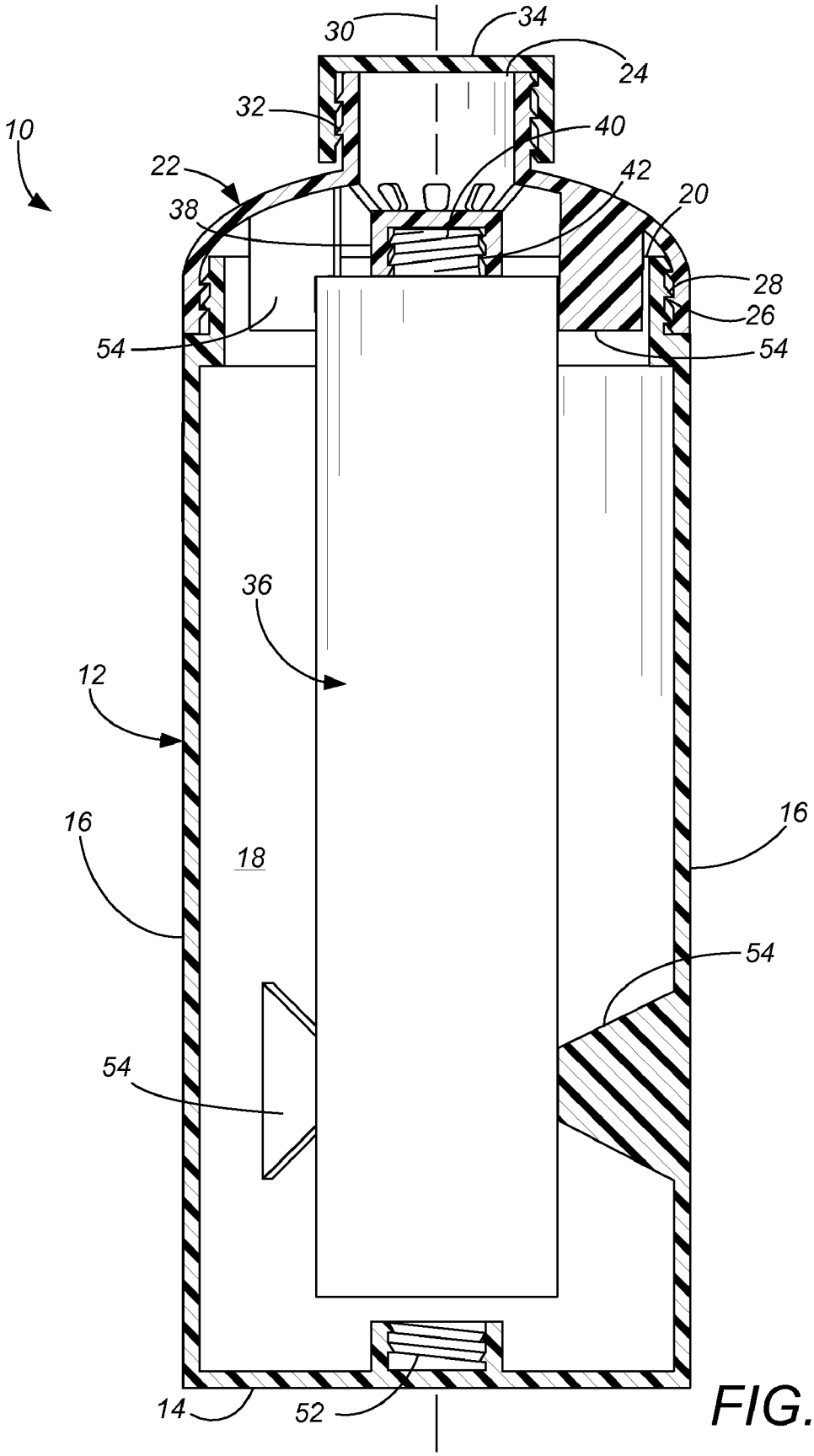
FIG. 8 is a cross-sectional view showing an alternative container together with the lid and freeze pack of FIGS. 1-6 in accordance with the present invention.

FIG. 8 shows an alternative embodiment, wherein the freeze pack 36 can optionally be screwed upside down into the container body 12. By having the freeze pack 36 mate with the container body 12, the frozen freeze pack 36 can be placed in the container body 12 prior to filling the container 10 with liquid, thereby avoiding overflow. In the embodiment of FIG. 8, the freeze pack 36 can be screwed optionally either into the container body 12 or into the lid 22 at the choice of the user. If the pitch and direction of the threads 52 on the freeze pack 36 matches the pitch and direction of the threads 26, 28 between the container body 12 and the lid 22, screwing the lid 22 onto the container body 12 can simultaneously screw the freeze pack 36 into the lid 22. In this embodiment, the consumer has the option of orienting the freeze pack 36 so it screws into the container body 12 or orienting the freeze pack 36 so it screws into the lid 22. In the embodiment of FIG. 8, both the container body 12 and the lid 22 have spacer supports 54 to contacts and help further support the freeze pack 36 at its location along the central axis 30. For instance, three spacer supports 54 shaped as fins can be circumferentially spaced around each of the upper and lower ends of the freeze pack 36. By having the freeze pack 36 contacted at both its upper and lower ends, the freeze pack 36 is less likely to break or come detached during rough handling of the container 10.

Figure 9:
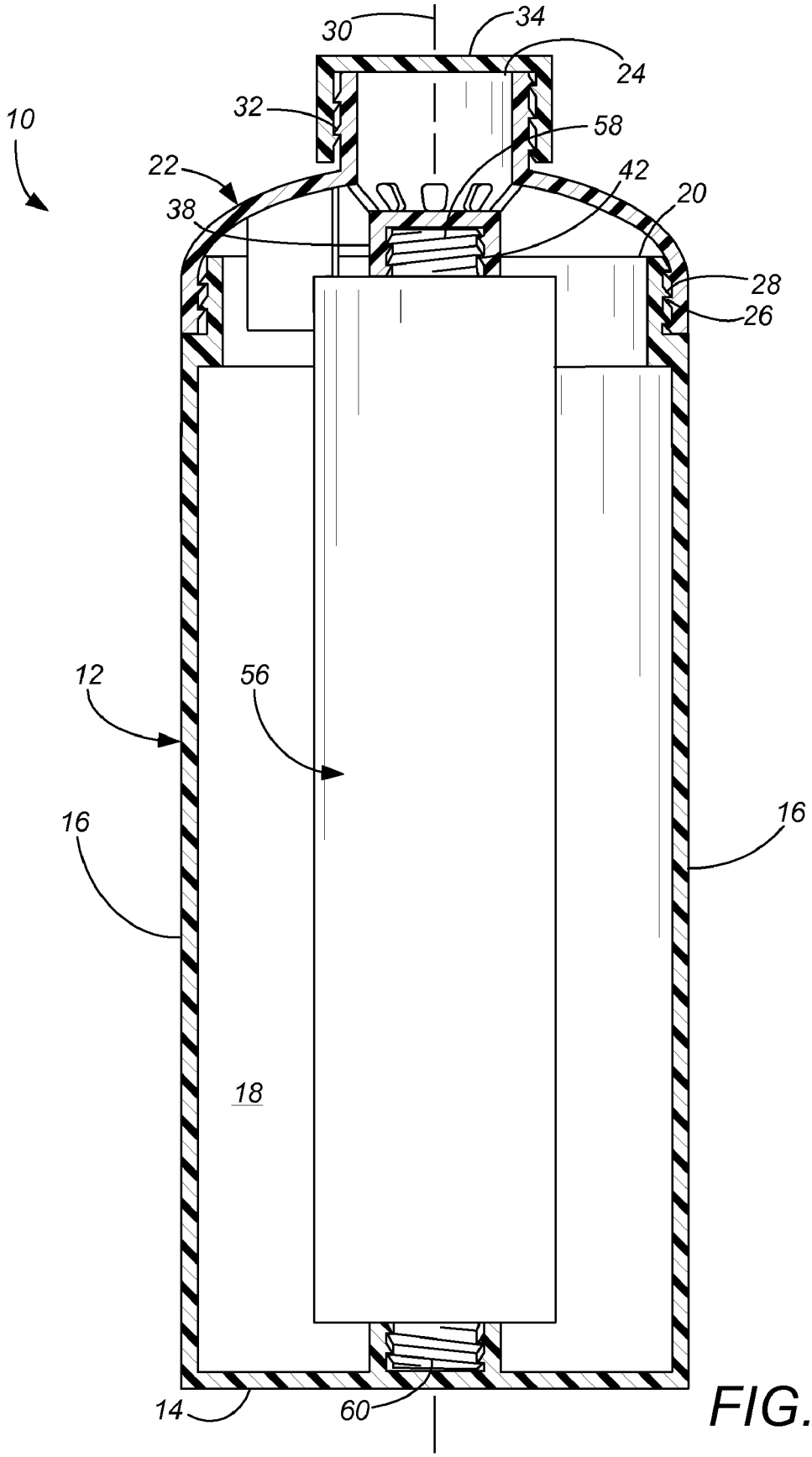
FIG. 9 is a cross-sectional view showing an alternative container and freeze pack together with the lid of FIGS. 1-6 in accordance with the present invention.

Other embodiments of the invention such as shown in FIG. 9 provide structure on the container body which secures the location of the freeze pack within the container body. In the embodiment of FIG. 9, a freeze pack 56 is formed with threads 58, 60 on both ends. The lower threads 60 connecting the freeze pack 56 to the base 14 are reverse threaded. By having the lower threads 60 reverse threaded, the freeze pack 56 will remain with the body 12 of the container 10 when the lid 22 is unscrewed relative to the container body 12.

With the design of the present invention, the freeze pack 36, 56 can be removed from the lid 22 and from the container 10 for cooling such as in a home freezer. Then, the freeze pack 36 can be screwed into the lid 22 (or the container body 12 in the embodiments of FIGS. 8 and 9). The container 10 can be filled with the lid 22 off, either with or without the freeze pack 36, 56 in place. Then, with the freeze pack 36, 56 in place, the lid 22 can be subsequently screwed onto the container body 12 without mixing or sloshing of the liquid in the container 10, because the freeze pack 36, 56 is positioned at the central axis 30 and accordingly only rotates (without translation) as the lid 22 is screwed on. Further, the connection between the lid 22 and the freeze pack 36 is strong and secure, which is important as the bottle 10 may be thrown around or otherwise receive rough treatment without having the freeze pack 36, 56 break and without having the connection between the freeze pack 36, 56 and the receiver tube 38 break.

Although the present invention has been described with reference to preferred embodiments, workers skilled in the art will recognize that changes may be made in form and detail without departing from the spirit and scope of the invention.

The invention claimed is:

1. A container for liquids intended to be heated or cooled, comprising:
- a body having a base and a peripheral wall extending upwardly from the base and defining a container interior and a lid opening;
- a lid which closably mates with the lid opening, with a drinking opening defined in the lid, the lid having a conical wall extending upwardly and outwardly relative to a central axis of the container;
- a plurality of flow slots extending radially within the lid for fluid communication between the drinking opening and the container interior, wherein the plurality of flow slots are circumferentially spaced in the conical wall of the lid;
- a thermal pack receptacle defined in the lid lower than the flow slots; and
- a thermal pack which mates with the thermal pack receptacle such that the thermal pack is releasably received by the thermal pack receptacle, the thermal pack and the thermal pack receptacle making continuous peripheral contact to releasably secure the thermal pack relative to the lid.

2. The container of claim 1, wherein the thermal pack includes threads which mate with threads of the thermal pack receptacle for receiving the thermal pack.

3. The container of claim 1, wherein the thermal pack comprises:
- a phase change material sealed within a thermal pack enclosure.

4. The container of claim 1, wherein the thermal pack receptacle receives the thermal pack in a location which is centered relative to the container.

5. The container of claim 4, wherein the drinking opening is centered relative to the container.

6. The container of claim 1, wherein the drinking opening is centered relative to the container.

7. The container of claim 1, further comprising a movable closure member for the drinking opening.

8. A container for liquids intended to be heated or cooled, comprising:
- a body having a base and a peripheral wall extending upwardly from the base and defining a container interior and a lid opening;
- a lid which closably mates with the lid opening, with a drinking opening defined in the lid;
- at least one flow slot extending radially within the lid for fluid communication between the drinking opening and the container interior;
- a thermal pack receptacle defined in the lid lower than the flow slot; and
- a thermal pack which mates with the thermal pack receptacle such that the thermal pack is releasably received by the thermal pack receptacle, the thermal pack and the thermal pack receptacle making continuous peripheral contact to releasably secure the thermal pack relative to the lid, wherein the body contacts the thermal pack to support the thermal pack relative to the container.

9. The container of claim 8, wherein the flow slot extends within a vertically extending wall of the lid.

10. The container of claim 8, wherein the flow slot extends within a sloping wall of the lid.

11. The container of claim 10, wherein a plurality of flow slots are circumferentially spaced in a conical wall of the lid, with the conical wall extending upwardly and outwardly relative to a central axis of the container.

12. The container of claim 8, wherein the container comprises a lower thermal pack receptacle extending upward from the base, the lower thermal pack receptacle making contact with a lower portion of the thermal pack to support the thermal pack relative to the container.

13. The container of claim 12, wherein the lower thermal pack receptacle comprises threads, and wherein the thermal pack includes lower threads which mate with threads of the lower thermal pack receptacle for supporting the thermal pack relative to the container.

14. The container of claim 8, wherein the body comprises support fins extending from the peripheral wall for contact with the thermal pack.

15. The container of claim 8, wherein the lid comprises threads which mate with threads on the body of the container to releasably attach the lid to the body.

16. A thermal lid for a beverage container comprising:
- a lid having a drinking opening accessible in a top of the lid, the lid comprising:
  - at least one flow slot projecting radially within the lid for fluid communication between the drinking opening and a container interior beneath the lid;
  - a horizontal wall extending beneath the flow slot;
  - a vertical wall projecting downward from the horizontal wall the vertical wall and the horizontal wall jointly defining a thermal pack receptacle separated from the flow slot; and
- a thermal pack which mates with the thermal pack receptacle such that the thermal pack is received by the thermal pack receptacle, wherein the thermal pack receptacle makes continuous peripheral contact with the thermal pack to releasably secure the thermal pack relative to the lid.

17. A thermal lid for a beverage container comprising:

a lid having a drinking opening accessible in a top of the lid, the lid comprising:

a plurality of flow slots circumferentially spaced in a conical wall of the lid, with the conical wall extending upwardly and outwardly relative to a central axis of the lid, the flow slots projecting radially within the lid for fluid communication between the drinking opening and a container interior beneath the lid;

a horizontal wall extending beneath the flow slots;

a vertical wall projecting downward from the horizontal wall, the vertical wall and the horizontal wall jointly defining a thermal pack receptacle separated from the flow slots; and a thermal pack which mates with the thermal pack receptacle such that the thermal pack is received by the thermal pack receptacle.

18. A thermal lid for a beverage container comprising:

a lid having a drinking opening accessible in a top of the lid, the lid comprising:

at least one flow slot projecting radially within the lid for fluid communication between the drinking opening and a container interior beneath the lid;

a horizontal wall extending beneath the flow slot;

a vertical wall projecting downward from the horizontal, wall the vertical wall and the horizontal wall jointly defining a thermal pack receptacle separated from the flow slot, wherein the lid permits vertical viewing through the lid through the at least one flow slot and through the drinking opening; and a thermal pack which mates with the thermal pack receptacle such that the thermal pack is received by the thermal pack receptacle.

* * * * *